US006914019B2

(12) United States Patent
Heine

(10) Patent No.: US 6,914,019 B2
(45) Date of Patent: Jul. 5, 2005

(54) CLOTHING ELEMENT

(75) Inventor: Goetz Heine, Mindelheim (DE)

(73) Assignee: Evelyn Gorgos, Westerham (DE)

( * ) Notice: Subject to any disclaimer, the term of this patent is extended or adjusted under 35 U.S.C. 154(b) by 239 days.

(21) Appl. No.: 09/861,556

(22) Filed: May 22, 2001

(65) Prior Publication Data

US 2002/0081407 A1 Jun. 27, 2002

(30) Foreign Application Priority Data

Dec. 22, 2000 (DE) ..... 200 21 700 U

(51) Int. Cl.[7] ..... B32B 27/04

(52) U.S. Cl. ..... 442/101; 428/299.1; 428/457; 428/458; 428/473.5; 428/474.4; 428/480; 442/59; 442/76; 442/78; 442/110; 442/117; 442/164; 442/179; 442/181; 442/231; 442/286; 442/316

(58) Field of Search ..... 428/131, 299.1, 428/343, 344, 354, 457, 458, 473.5, 474.4, 480, 908.8; 442/6, 16, 19, 21, 43, 45, 46, 47, 49, 59, 76, 78, 101, 110, 117, 164, 167, 168, 169, 179, 181, 231, 286, 316

(56) References Cited

U.S. PATENT DOCUMENTS 3,918,141 A * 11/1975 Pepper et al. ..... 29/419.1
4,015,347 A 4/1977 Morishita et al.
4,151,660 A 5/1979 Yoshimi et al.
4,420,757 A * 12/1983 Ebneth et al. ..... 343/912
4,621,012 A * 11/1986 Pusch ..... 442/228
4,743,478 A * 5/1988 Pusch ..... 428/17
4,816,124 A * 3/1989 Manabe et al. ..... 204/192.14
4,927,683 A * 5/1990 Tsutsui ..... 428/90
5,001,848 A 3/1991 Okayasu
5,089,105 A * 2/1992 Tsutsui ..... 204/192.14
6,015,613 A * 1/2000 Kinlen et al. ..... 428/332
6,191,056 B1 * 2/2001 Vogt et al. ..... 442/148
6,242,369 B1 * 6/2001 Vogt et al. ..... 442/148

FOREIGN PATENT DOCUMENTS

DE 29 12 793 A1 10/1979
DE 34 00 049 A1 7/1985
DE 37 34 950 A1 5/1989
DE 37 37 302 A1 5/1989
DE 39 42 094 A1 6/1991

* cited by examiner

*Primary Examiner*—Arti R. Singh
(74) *Attorney, Agent, or Firm*—Venable LLP; Robert Kinberg; Thomas G. Wiseman

(57) ABSTRACT

A clothing element includes a carrier of a form that conforms to a portion of a body surface and an adherent coating made of titanium or of a titanium alloy and/or titanium compound located on one side of the carrier facing the body surface. The adherent coating increases the physical performance and the physical wellness of a body by for example, positively influencing muscle contractility and vasoactivity, and counteracting signs of fatigue and formation of sweat.

17 Claims, 2 Drawing Sheets

CLOTHING ELEMENT

BACKGROUND OF THE INVENTION

1. Field of the Invention

The present invention relates generally to a clothing element. More specifically the present invention relates a clothing element having an adherent coating.

2. Related Art

The present invention involves an inner sole or insole—specifically for a sport shoe/boot—or also a sock or long sock, which can be worn in the sport and fitness or wellness field. Then present invention can also be realized in other clothing elements such as a headband or a cap, a glove or in arm, leg or other bandages or the like.

Inner soles or insoles for footwear having metallic elements are specifically known.

For example, an inner sole is described in U.S. Pat. No. 4,015,347, which is supposed to have a healing or injury-preventing action by means of a metallic layer consisting of silver, copper or an alloy thereof. In such an inner sole, the metals are incorporated in the plastic material of the inner sole in the form of small particles.

Additionally, in U.S. Pat. No. 4,151,660, a deodorant sock for being worn in footwear is described, containing a core of a copper-containing metal having a deodorant action that is known per se.

Further, in DE 29 12 793 A1, a shoe insole having a multilayer structure, which inter alia comprises a latex layer containing activated carbon powder, copper powder and magnetic powder, as well as a method for producing such an insole is described. This insole is supposed to exhibit a deodorant, fungicidal and magnetizing action.

In DE 34 00 049 A1, a further specific inner sole is described, which is supposed to achieve a blood circulation-promoting action in that rivet heads of copper are provided on its side facing the foot. To additionally achieve a deodorant action, a layer of finely ground activated carbon filter material is provided on the side of the inner sole facing towards the shoe.

In DE 37 34 950 A1, an inner sole having an orthopedic support function is described. Such an inner sole comprises a cover layer of a material which is kind to the skin such as, for example, leather or a textile top material, and also has—in a specific configuration—a reinforcement layer of a metal (i.e., a spring steel).

DE 37 37 302 A1 describes an inner sole of conventional materials and of conventional structure, containing metallic germanium or a germanium-containing material in a finely dispersed form. In preferred embodiments of that invention, the material is applied on a carrier by spraying, coating or imprinting of a dispersion.

In DE 39 42 094 A1, an inner sole and insole for a shoe of a hard material is described, which are intended to protect and support the foot.

In U.S. Pat. No. 5,001,848, an inner sole having a metallic core is described, at least one portion of which being formed by an amorphous metal foil. This inner sole is extremely flexible, and is particularly supposed to offer protection against damages to the shoe or injuries of the wearer caused by pointed objects.

The known inner soles, insoles or socks similar to types described above are supposed to mainly achieve a deodorant, in part also a fungicidal or mechanically stabilizing action.

OBJECTS OF THE INVENTION

It is an object of the invention to provide a clothing element exhibiting advantageous actions as to the physical fitness and the wellness, respectively, of the user.

SUMMARY OF THE INVENTION

The above and other objects of the invention are achieved by a clothing element having a carrier and an adherent coating. The carrier has a form adapted to a portion of a body surface. The adherent coating is on the side of the carrier facing the body of the wearer and includes titanium or a titanium alloy.

BRIEF DESCRIPTION OF THE DRAWINGS

The foregoing and other features and advantages of the invention will be apparent from the following, more particular description of an exemplary embodiment of the invention, as illustrated in the accompanying drawings wherein like reference numbers generally indicate identical, functionally similar, and/or structurally similar elements.

DETAILED DESCRIPTION OF EMBODIMENTS OF THE INVENTION

Figure 1:
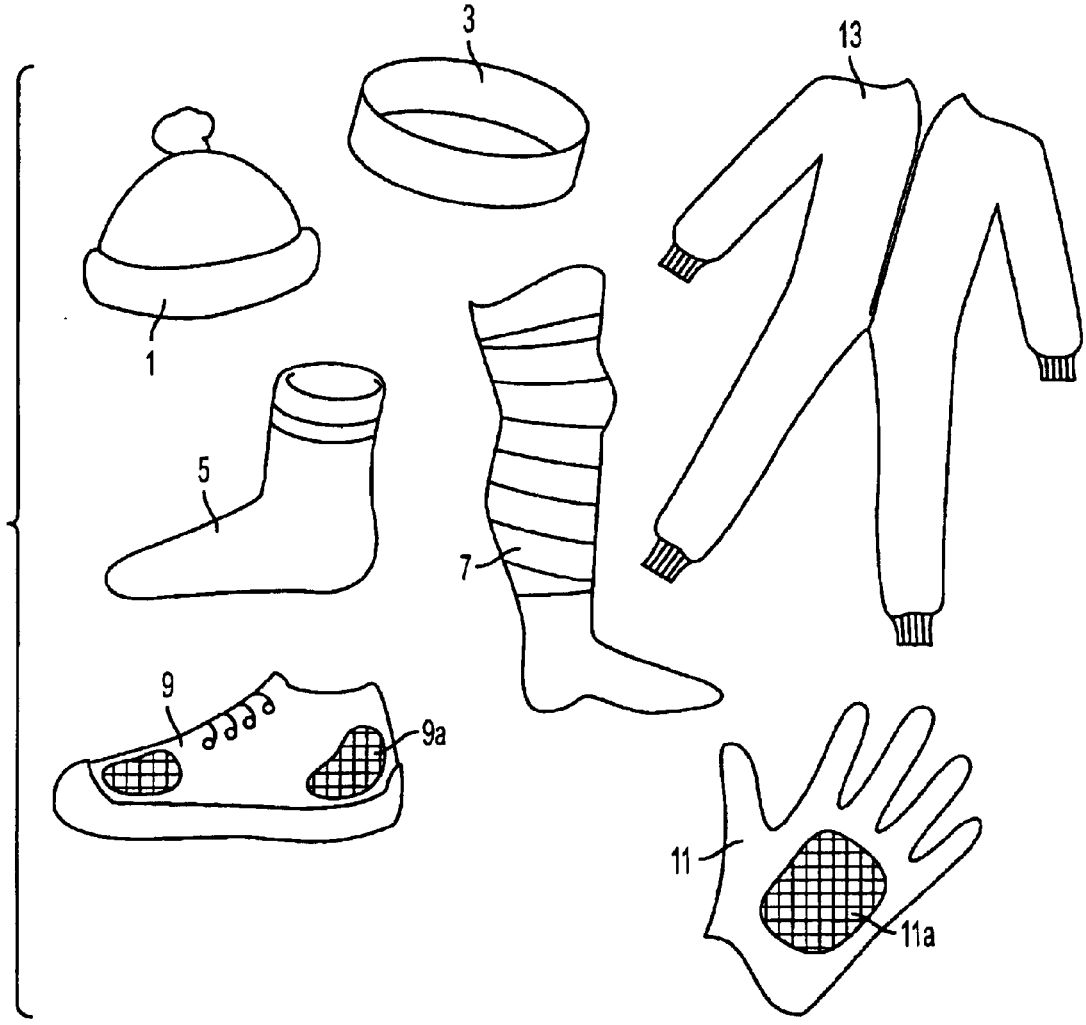
FIG. 1 schematically shows a variety of clothing elements comprising the inventive coatings.

Embodiments of the invention are discussed in detail below. In describing embodiments specific terminology is employed for the sake of clarity. However, the invention is not intended to be limited to the specific terminology so selected. While specific exemplary embodiments are discussed, it should be understood that this is done for illustration purposes only. A person skilled in the art will recognize that other components and configurations can be used without parting from the spirit of the invention. All references cited herein are incorporated by reference.

The present invention provides a carrier adapted in its respective area to the specific application and to the shape of the body surface with a thermally and electrically conductive and extremely biocompatible coating. Such a coating has a cooling action, as well as bioelectrical actions, which, by means of appropriate specific configurations of the carrier and/or the coating can be optimized for specific application situations. The invention moreover provides for selecting titanium or a titanium alloy and/or titanium compound as the material for this coating.

A clothing element according to the present invention positively influences muscle contractility and vasoactivity, and counter-acts signs of fatigue and the formation of foot sweat.

In an exemplary embodiment of the invention, due to the cancellation of mechanical influences of the coating with respect to the carrier, the coating is configured as a thin layer. In this form, it can be applied on the carrier in particular by a vacuum deposition process such as evaporation coating or sputtering. Its thickness can be set in particular to a range between 100 $\mu$m and 100 $\mu$m, preferably between about 5 $\mu$m and 20 $\mu$m.

For applications with a high abrasion risk—for example for inner soles or insoles—one will preferably select a higher thickness, all the more, since with clothing elements of the mentioned kind, a reinforcing action of higher layer thicknesses scarcely counts as being a disadvantage. In contrast thereto, a coating of carriers for clothing elements of a high flexibility—e.g. caps, headbands or gloves—is rather to be provided in a lower layer thickness.

For increasing the adhesive capacity of the coating and hence, for prolonging the lifetime (or efficiency duration of the advantageous action) of the clothing element, a suitable adhesion agent layer can be provided between the surface of the carrier and the proposed coating. Adhesion agent layers for improving the adhesive capacity of metal layers on plastic materials are known per se and therefore do not require a detailed description in this case.

The material of the carrier is to be selected to a large extent depending upon the materials known for the respective purpose of use. Preferred from the present point of view are flexible plastic carriers, which can comprise polyacrylonitrile fibres, polyester fibres and/or polyamide fibres. Inner soles or insoles can also be prefabricated as a formed solid plastic part and be provided with the coating. Moreover, the use of textiles or knit fabrics of the mentioned materials—or also of other textile fibres—lends itself for many applications. Among these count realizations such as knitwear (e.g. undershirts, shorts or T-shirts), overalls for sport or working purposes or other pieces of outer garments.

For "high end" applications, e.g. for inner soles or insoles of high-performance sport shoes/boots for cyclists, triathletes or skiers, carriers with a carbon fibre portion can be advantageously used. Particularly carbon fibre-reinforced plastics distinguish in a known manner by excellent mechanical properties, and the combination thereof with the advantageous performance-increasing actions of the proposed coating enables the production of high-quality clothing elements—in particular sport shoes/boots—for high-performance sports.

For a plurality of applications, the entire surface of the carrier facing the body will essentially be provided with the titanium coating; for other applications, however, a merely partial coating is purposeful. The coated surfaces are in this case predetermined in particular as to physiological or bio-electrical aspects. With the configuration, the findings of modern physiotherapy can inter alia be used.

An improved ventilation of the body area covered with the coated carrier can be obtained, if necessary, by a carrier provided with recesses. These recesses can in particular be formed by throughholes through the entire thickness of the carrier; alternatively, the provision of grooves acting as air channels on the side of the carrier facing the body surface is also possible. It is understood that the above-mentioned textiles and knit fabrics allow for a certain ventilation of the body surface already due to the specificity of the material compound. However, additional, larger recesses are purposeful in specific configurations.

Furthermore, the carrier can have a grid-like or net-like configuration, and namely independent of a textile structure. Thus, even a semi-rigid inner sole or insole of solid material can eventually have—at least in part—a grid-structure.

Referring now to the drawings, in FIG. 1, a cap 1, a headband 3, a sport sock 5, a bandage 7, a sport shoe 9, a glove 11, and an overall 13 are shown which all comprise an exemplary carrier material the form of which is adapted to a portion of the body surface when in use and which on one side of the carrier facing the body have an adherent coating of titanium or at titanium alloy.

The sport shoe 9 as well as the glove 11 can have portions 9*a* or 11*a*, respectively, where they have a grid-like or net-like carrier which is coated with titanium or a titanium alloy as well.

All shown clothing elements—except parts of the sport shoe 9—are made from a fabric carrier which is preferably made of polyacrylonitrile, polyester and/or polyamid fibres. The coating is provided on one side of the fabric as a whole or, alternatively, on the single fibres; see below.

Figure 2:
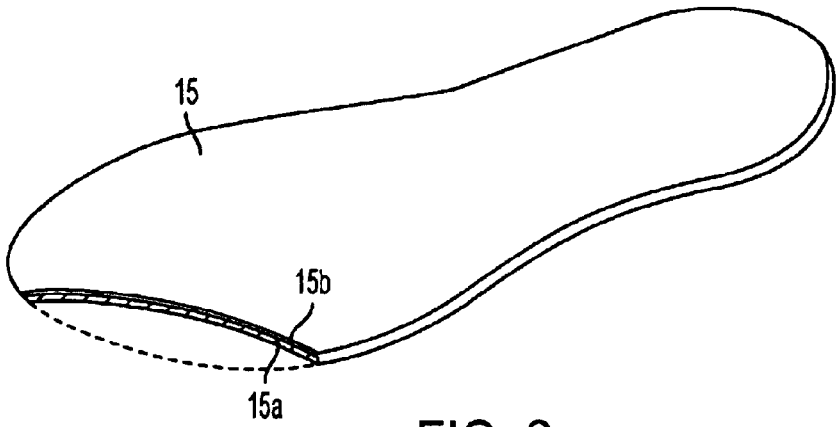
FIG. 2 shows a perspective view of an insole according to a further embodiment of the invention.

FIG. 2 shows an insole 15, especially suitable for a sport shoe, which is composed of a flexible plastic carrier 15*a* comprising carbon fibres (not shown) for improving the mechanical stability and a very thin, sputtered titanium alloy coating 15*b*.

Figure 3:
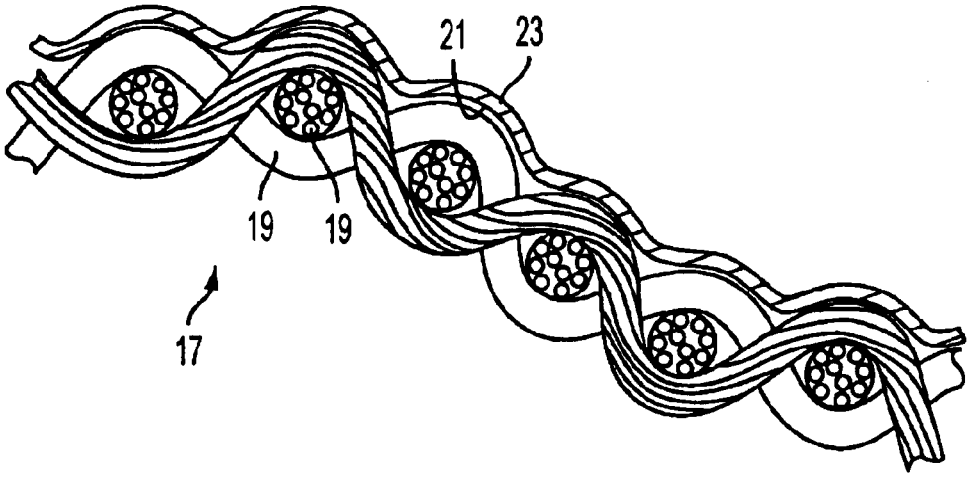
FIG. 3 shows a (simplified) cross-section of a fabric comprising the inventive coating according to a further embodiment of the invention.

FIG. 3 shows a cross-section of a fabric 17 (which may be used e.g. for producing some of the clothing elements shown in FIG. 1) which is composed of woven fibres 19. The fabric 17 can be, on its upper surface 17*a*, coated with a first coating layer 21 of an adhesion agent and a second coating 23 of metallic titanium or a titanium compound, respectively. The intermediate layer 21 serves for improving the adhesion of the metallic or compound layer 23 to the fibres and for improving the flexibility thereof to avoid cracks and other damages during the practical use of the fabric.

The realization of the invention is not restricted to the above-mentioned construction and application examples, but it is likewise possible in a plurality of variations, which are within the scope of the skilled person's proceedings.

The embodiments illustrated and discussed in this specification are intended only to teach those skilled in the are the best way known to make and use the invention. Nothing in this specification should be considered as limiting the scope of the present invention. All examples presented are representative and non-limiting. The above-described embodiments of the invention may be modified, or varied, without deporting from the invention, as appreciated by those skilled in the art in light of the above teachings. It is therefore to be understood that, within the scope of the claims and their equivalents, the invention may be practiced otherwise than as specifically described.

What is claimed is:

1. A clothing element comprising:

a carrier having a form adaptable to a portion of a body surface; and an adherent coating on one side of the carrier for facing a body of a wearer of the clothing element, the adherent coating including one of titanium and a titanium alloy for increasing physical performance and physical wellness of the wearer of the clothing element.

2. The clothing element according to claim 1, wherein the adherent coating further comprises a thin layer produced on the carrier in by means of a vacuum deposition process.

3. The clothing element according to claim 1, further comprising:

an adhesion agent layer interposed between a surface of the carrier and the coating.

4. The clothing element according to claim 1, wherein the carrier is a substantially plastic, flexible carrier and includes at least one of polyacrylonitrile fibers, polyester fibers, and polyamide fibers.

5. The clothing element according to claim 1, wherein the carrier comprises carbon fibers.

6. The clothing element according to claim 1, wherein an entire surface of the carrier facing the body is substantially provided with the adherent coating.

7. The clothing element according to claim 1, wherein a surface of the carrier facing the body is in part provided with the coating in areas predetermined by physiological and bioelectrical aspects.

8. The clothing element according to claim 1, wherein the carrier further comprises one of recesses and throughholes, for ventilating the body surface.

9. The clothing element according to claim 8, wherein the carrier is a grid-like or net-like carrier.

10. The clothing element according to claim 1, wherein the carrier is one of a woven and knitted carrier, the threads of which are at least in part individually coated.

11. The clothing element according to claim 1, wherein the clothing element is one of an inner sole and insole for one of a sport shoe and a boot.

12. The clothing element according to claim 10, wherein the clothing element is a sport sock.

13. The clothing element according to claim 10, wherein the clothing element is one of an undershirt, shorts, a T-shirt and a sweater.

14. The clothing element according to claim 10, wherein the clothing element is an overall.

15. The clothing element according to claim 10, wherein the clothing element is one of a headband and a cap.

16. The clothing element according to claim 10, wherein the clothing element is a glove.

17. The clothing element according to claim 10, wherein the clothing elements is a bandage.

* * * * *